US008302588B2

(12) United States Patent
Chen

(10) Patent No.: US 8,302,588 B2
(45) Date of Patent: Nov. 6, 2012

(54) TOY GUN PISTON WITH A DETACHABLE TOOTHED STRUCTURE

(75) Inventor: Jeffrey Chen, Shalu Township, Taichung County (TW)

(73) Assignee: J.B. Unicorn Ltd., Taichung County (TW)

( * ) Notice: Subject to any disclaimer, the term of this patent is extended or adjusted under 35 U.S.C. 154(b) by 177 days.

(21) Appl. No.: 12/904,251

(22) Filed: Oct. 14, 2010

(65) Prior Publication Data

US 2012/0090587 A1 Apr. 19, 2012

(51) Int. Cl.
*F41B 11/00* (2006.01)

(52) U.S. Cl. ..... 124/64; 124/66

(58) Field of Classification Search ..... 124/63–67
See application file for complete search history.

(56) References Cited

U.S. PATENT DOCUMENTS 1,618,976 A * 3/1927 Hofmann ..... 42/1.11
2,070,355 A * 2/1937 Chevallier et al. ..... 89/150
2,305,176 A * 12/1942 Littman ..... 43/19
2,699,768 A * 1/1955 Gladen ..... 124/29
3,128,753 A * 4/1964 Politzer ..... 124/26
4,095,363 A * 6/1978 Riedl ..... 42/23
6,578,565 B2 * 6/2003 Casas Salva ..... 124/73
7,077,117 B1 * 7/2006 Chu ..... 124/32
7,216,449 B2 * 5/2007 Riebling et al. ..... 42/70.07
7,966,760 B2 * 6/2011 Fitzpatrick et al. ..... 42/72
2002/0092514 A1 * 7/2002 Salva ..... 124/71
2006/0137671 A1 * 6/2006 Chu ..... 124/32

* cited by examiner

*Primary Examiner* — Michael David
(74) *Attorney, Agent, or Firm* — Ming Chow; Sinorica, LLC

(57) ABSTRACT

A piston structure for a toy gun includes a piston body and a detachable toothed member. The piston body has a chute which is axially disposed on an outer surface of the piston body. The detachable toothed member is made of a metallic material and moveably disposed in the chute. The detachable toothed includes a plurality of teeth which are equally spaced in a lengthwise direction. The piston structure of the present invention provides a longer service life. In case the teeth of the detachable toothed member suffer a lot of wear and tear, the detachable toothed member can be detached from the chute and replaced with a new one to save the cost and to provide an environmental protection effect.

8 Claims, 6 Drawing Sheets

TOY GUN PISTON WITH A DETACHABLE TOOTHED STRUCTURE

BACKGROUND OF THE INVENTION

1. Field of the Invention

The present invention relates to a piston structure for a toy gun.

2. Description of the Prior Art

Referring to FIG. 1, a conventional toy gun 1 comprises a cylinder pipe 2, a piston 3, a spring 4, and a gear mechanism 5. The piston 3 is moveably disposed in the cylinder pipe 2. The spring 4 leans against the piston 3 which faces one end of the cylinder pipe 2, such that the piston 3 has a preset force to move toward the cylinder pipe 2. The piston 3 is provided with teeth 6 on an outer surface thereof in a lengthwise direction. The teeth 6 mesh with the gear mechanism 5 and is driven by the gear mechanism 5 to bring the piston 3 to reciprocate in the cylinder pipe 2. However, the gear mechanism 5 is made of a metallic material and the teeth 6 are made of a plastic material. After a period of use, the teeth 6 will suffer a lot of wear and tear. Because the teeth 6 are integrally formed with the piston 3, it is necessary to replace a new piston 3 with the teeth 6 after the teeth 6 suffer a lot of wear and tear. This is not cost-effective and friendly to the environment. Accordingly, the inventor of the present invention has devoted himself based on his many years of practical experiences to solve this problem.

SUMMARY OF THE INVENTION

The present invention is to provide a piston structure for a toy gun, which comprises a piston body and a detachable toothed member. The piston body has a chamber therein, an opening at one end thereof, and a chute which is axially disposed on an outer surface of the piston body. The detachable toothed member is made of a metallic material and moveably disposed in the chute. The detachable toothed member comprises an elongated plate and a plurality of teeth which are equally spaced and disposed on the plate in a lengthwise direction. The piston structure of the present invention provides a longer service life. In case the teeth of the detachable toothed member suffer a lot of wear and tear, the detachable toothed member can be detached from the chute and replaced with a new one to save the cost and to provide an environmental protection effect.

DETAILED DESCRIPTION OF THE PREFERRED EMBODIMENTS

Embodiments of the present invention will now be described, by way of example only, with reference to the accompanying drawings.

Figure 1:
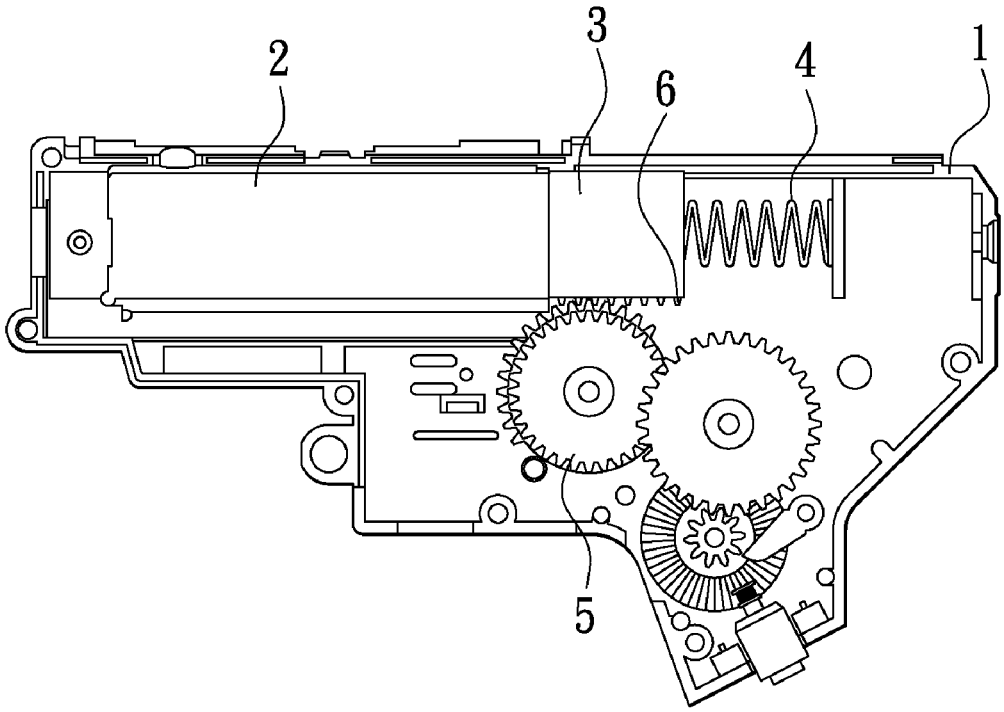
FIG. 1 PRIOR ART
FIG. 1 is a schematic view of a conventional toy gun.
Figure 2:
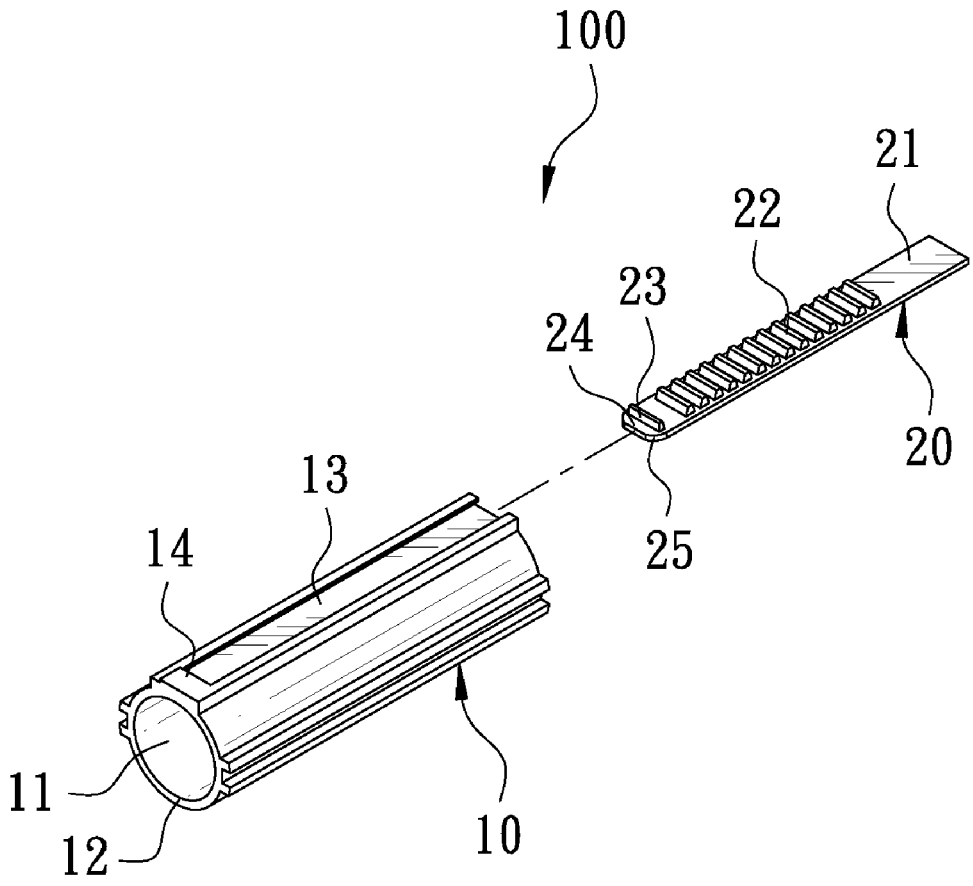
FIG. 2 is an exploded view according to a preferred embodiment of the present invention.
Figure 3:
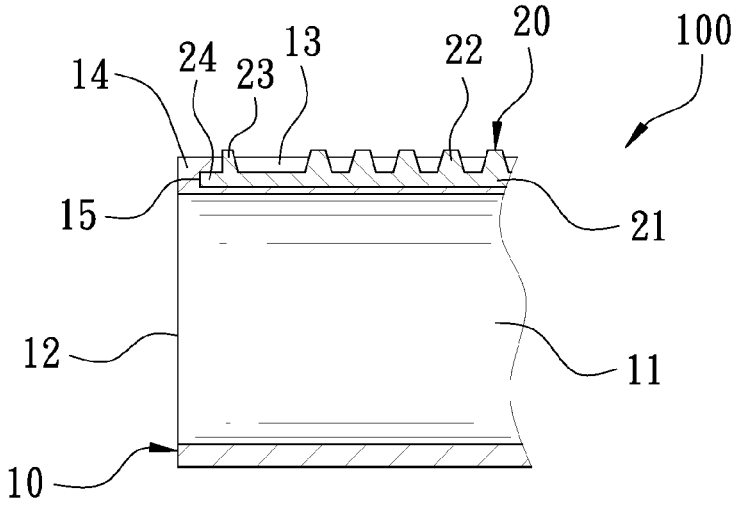
FIG. 3 is a partially enlarged view according to the preferred embodiment of the present invention.
Figure 4:
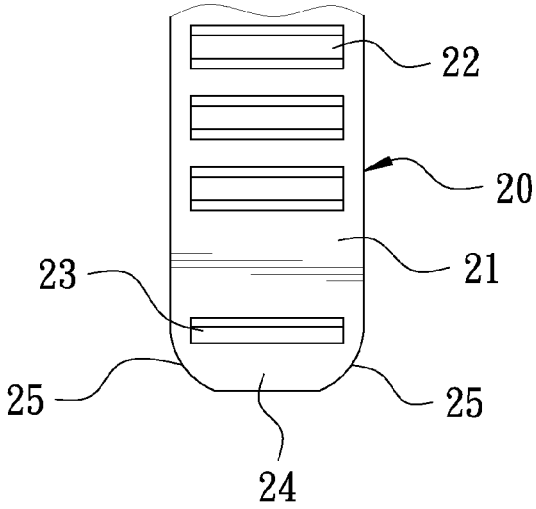
FIG. 4 is a partially enlarged view showing a detachable toothed member according to the preferred embodiment of the present invention.

As shown in FIGS. 2 to 4, a piston structure 100 for a toy gun according to a preferred embodiment of the present invention comprises a piston body 10 and a detachable toothed member 20.

The piston body 10 has a chamber 11 therein, an opening 12 at one end thereof, a chute 13 which is axially disposed on an outer surface of the piston body 10, and a stop block 14 which is located at one end of the chute 13 close to the opening 12. As shown in FIG. 3, the stop block 14 has an engaging trough 15 corresponding to the chute 13.

The detachable toothed member 20 is made of a metallic material and moveably disposed in the chute 13. The detachable toothed member 20 comprises an elongated plate 21 and a plurality of teeth 22 which are equally spaced and disposed on the plate 21 in a lengthwise direction. In this embodiment, the length of each of the teeth 22 is equal to the width of the chute 13. Furthermore, one end of the plate 21 is provided with a positioning block 23 corresponding to the stop block 14 and an engaging block 24 corresponding to the engaging trough 15. The engaging block 24 has two arc faces 25 at two corners of the engaging block 24.

Figure 5:
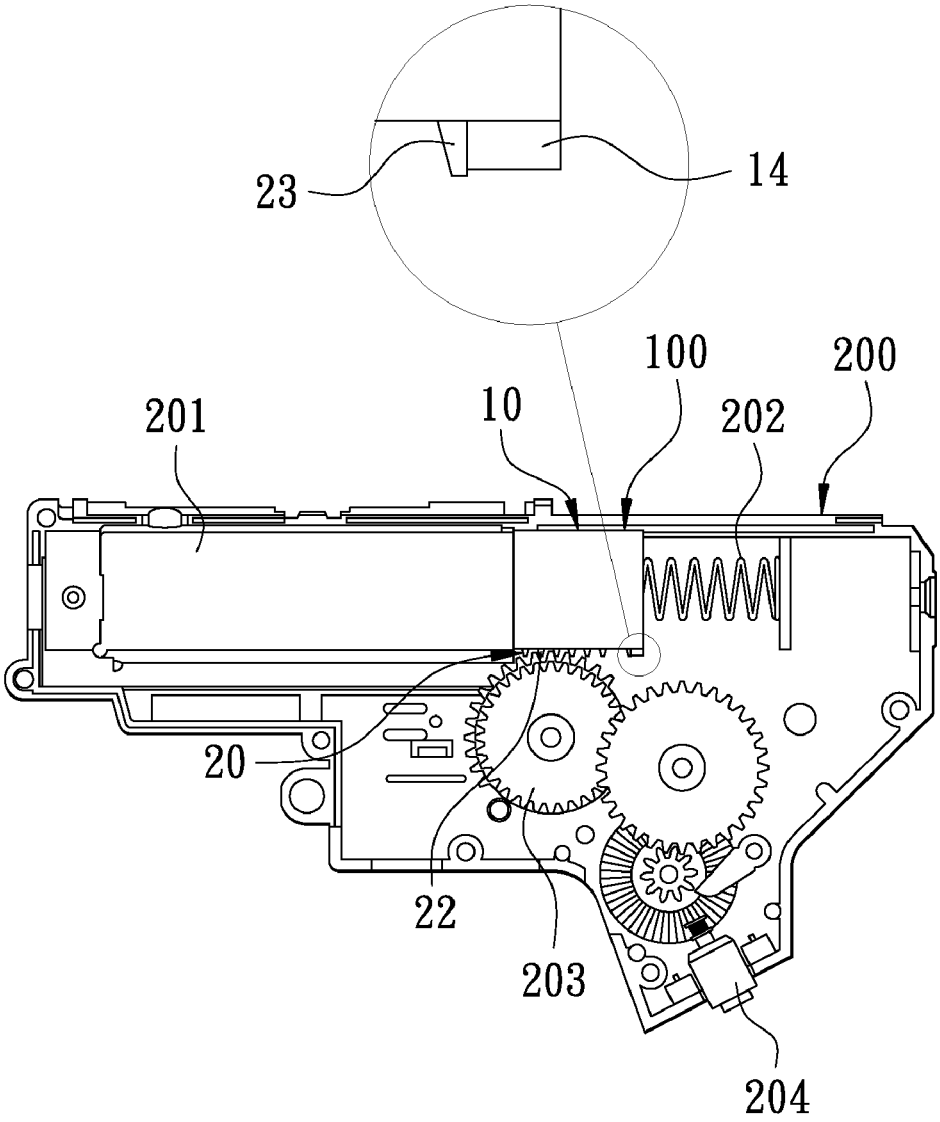
FIG. 5 is a schematic view of the preferred embodiment of the present invention when in use.

FIG. 5 shows the preferred embodiment of the present invention when in use. To assemble the present invention, the end having the stop block 24 of the detachable toothed member 20 is aimed at the chute 13 of the piston body 10 to be inserted therein. The engaging block 24 is engaged with the engaging trough 15, and the positioning block 23 is blocked by the stop block 14. Thus, the present invention is assembled completely. It is noted that the two arc faces 25 of the engaging block 24 help the user to put the detachable toothed member 20 into the chute 13 with ease.

As shown in FIG. 5, the piston body 10 with the toothed member 20 is coupled to a toy gun 200. The toy gun 200 comprises a cylinder pipe 201, a spring 202, a gear mechanism 203, and a motor 204. The piston body 10 is slid in the cylinder pipe 201, with the opening 12 facing the spring 202, such that one end of the spring 202 can be inserted in the chamber 11 to provide an elastic force to the piston body 10 for the piston body 10 having a preset force to slide toward the cylinder pipe 201. The detachable toothed member 20 meshes with the gear mechanism 203. The gear mechanism 203 is connected with the motor 204. When the motor 204 is operated, the detachable toothed member 20 will be linked to bring the piston body 10 to move toward the spring 202. When the piston body 10 is moved to a predetermined position, the piston body 10 will be returned to its original position by the force of the spring 202.

It is noted that the stop block 14 on the piston body 10 corresponds to the positioning block 23 of the detachable toothed member 20 when the piston body 10 is moved toward the spring 202, which increases the contact area to lower the bearing stress of the stop block 14 so as to prevent the stop block 14 from breaking, and which transmits the force to the piston body 10 effectively for certainly bringing the piston body 10 to move toward the spring 202. The detachable toothed member 20 is made of a metallic material, which can enhance the service life of the detachable toothed member 20. In case the teeth 22 of the detachable toothed member 20 suffer a lot of wear and tear, the detachable toothed member 20 can be detached from the chute 13 and replaced with a new one. This saves the cost and provides an environmental protection effect.

Figure 6:
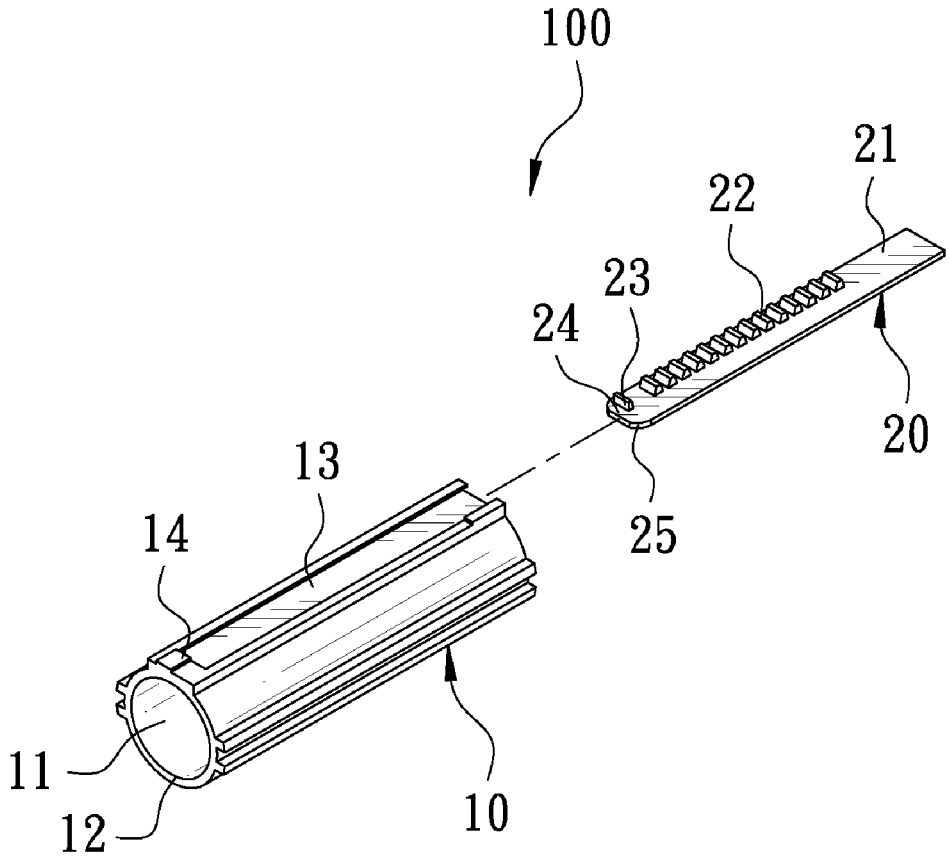
FIG. 6 is an exploded view according to another embodiment of the present invention.
Figure 7:
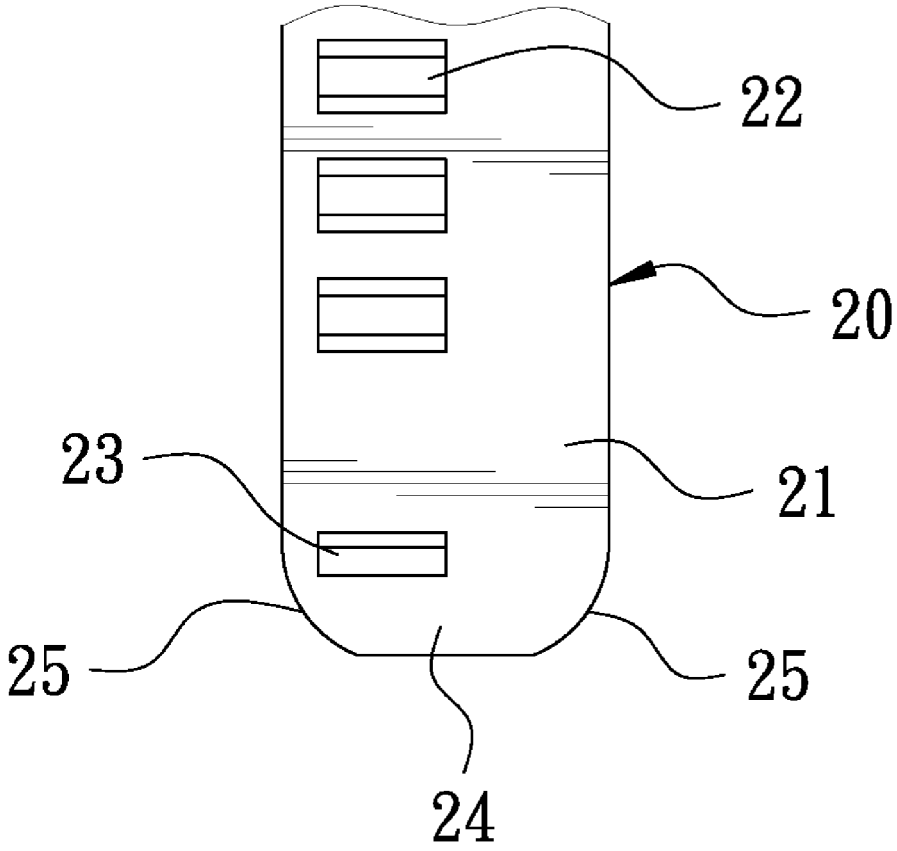
FIG. 7 is a partially enlarged view of FIG. 6 showing the detachable toothed member.

FIG. 6 and FIG. 7 show another embodiment of the present invention. The detachable toothed member 20 meshes with the gear mechanism 203 of the toy gun 200 and is driven by with the gear mechanism 203. The gear mechanism 203 on the market has two different specifications, a full size and a half size. This embodiment is substantially similar to the aforesaid preferred embodiment with the exceptions described thereafter. The length of each of the teeth 22 is half a width of the chute 13, corresponding to the gear mechanism 203 in a half size. Therefore, the piston structure 100 of the present invention is adapted to the toy gun 200 with the gear mechanism 203 in a half size.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A piston structure configured for a toy gun, comprising:

a piston body having a chamber therein, an opening at one end thereof and a chute which is axially disposed on an outer surface of the piston body; and a detachable toothed member moveably disposed in the chute, the detachable toothed member comprising an elongated plate and a plurality of teeth which are equally spaced and disposed on the plate in a lengthwise direction, the detachable toothed member being detachable from the piston body.

2. The piston structure as claimed in claim 1, wherein a stop block is provided at one end of the chute close to the opening.

3. The piston structure as claimed in claim 2, wherein one end of the plate is provided with a positioning block corresponding to the stop block.

4. The piston structure as claimed in claim 2, wherein the stop block has an engaging trough corresponding to the chute, and the end of the plate is provided with an engaging block corresponding to the engaging trough.

5. The piston structure as claimed in claim 4, wherein the engaging block has two arc faces at two corners of the engaging block.

6. The piston structure as claimed in claim 1, wherein each of the teeth has a length which is equal to a width of the chute.

7. The piston structure as claimed in claim 1, wherein each of the teeth has a length which is half a width of the chute.

8. The piston structure as claimed in claim 1, wherein the detachable toothed member is made of a metallic material.

* * * * *